United States Patent [19]

Wilt et al.

[11] Patent Number: 4,511,088

[45] Date of Patent: Apr. 16, 1985

[54] LIQUID DISTRIBUTION DEVICE

[75] Inventors: Henry E. Wilt, Neptune Beach; Larry N. Murray, Fernandina Beach, both of Fla.

[73] Assignee: Fabralloy, Inc., Jacksonville, Fla.

[21] Appl. No.: 446,867

[22] Filed: Dec. 6, 1982

[51] Int. Cl.[3] ..... B05B 1/32; D21C 9/02

[52] U.S. Cl. ..... 239/455; 239/523; 239/590.5; 239/597; 162/60

[58] Field of Search ..... 239/568, 597, 451.5, 239/590.5, 518, 520, 523, 524, 590.3, 566; 162/310, 204, 60; 210/391, 393; 118/63

[56] References Cited

U.S. PATENT DOCUMENTS

| | | | |
|---|---|---|---|
| 1,396,092 | 11/1921 | Binns | 239/523 X |
| 2,940,418 | 3/1959 | Penrod et al. | 239/597 X |
| 3,159,349 | 12/1964 | Crocco et al. | 239/590.3 X |
| 3,264,673 | 9/1966 | Scott | 118/63 |
| 3,419,466 | 12/1968 | Sepall | 162/204 |
| 3,454,970 | 7/1969 | Sutherland | 8/156 |
| 4,202,123 | 9/1981 | Lintunen et al. | 162/60 |
| 4,205,541 | 6/1980 | Zucker | 68/200 |

FOREIGN PATENT DOCUMENTS

| | | | |
|---|---|---|---|
| 2246029 | 9/1972 | Fed. Rep. of Germany | 162/310 |

*Primary Examiner*—Andres Kashnikow
*Assistant Examiner*—Kevin Patrick Weldon
*Attorney, Agent, or Firm*—Arthur G. Yeager

[57] ABSTRACT

A liquid distribution device comprising a tubular horizontal reservoir for holding liquid to be distributed, a plurality of passageways through the upper wall of the reservoir and communicating with an elongated space substantially enclosed by an elongated arcuate cap member extending lengthwise along the outside of the tubular reservoir, the cap member having an outlet edge which is adjustable with respect to the outside surface of the reservoir to produce an elongated narrow slit outlet through which the liquid can flow in the form of a thin sheet. This device finds its principal use in delivering wash liquid to a wet sheet of paper pulp.

16 Claims, 12 Drawing Figures

LIQUID DISTRIBUTION DEVICE

BACKGROUND OF THE INVENTION

There are many industrial operations which require that a supply of liquid be spread into a continuously flowing thin sheet and deposited on a surface. Among such operations is the step of forming a sheet of pulp that eventually becomes a finished pulp or paper product. In this operation, a large drum rotates partially submerged in a pool of pulp dispersed in water. As the drum rotates, a suction is applied from inside the drum causing pulp to be deposited on the drum. The wet pulp sheet on the drum must be washed several times to remove any impurities and recover the chemicals. In so doing, it is necessary to apply to the sheet of pulp sufficient wash water to displace the chemical laden liquid within the pulp sheet. It is not feasible to apply wash water in the form of a spray because it would cause loss of washing efficiency due to air impingement causing a displacement reduction. Because of economic and environmental requirements, it is desirable to operate with a minimum displacement ratio. Accordingly, it has been found necessary to distribute the wash water in the form of a thin film that can be applied gently to the surface of the moving sheet of wet pulp. Normally, there is a spillway surface which would direct a film of water tangentially onto the moving pulp sheet and the only problem is to be able to distribute the wash water evenly over the spillway so as to produce a consistent and gently flowing sheet of wash water to the wet pulp sheet. Spoon deflectors, whistle showers, and wires have been employed in the past to change individual streams of water into spray patterns that will distribute themselves automatically over the surface of a spillway. These have been unsatisfactory for several reasons including inconsistencies in the thickness of the film of water as well as inconsistencies in the uniformity of flow across the face of the washing apparatus. Furthermore, these previously used devices caused an undesirable amount of heat loss in the wash water.

Accordingly, it is an object of this invention to provide an improved liquid distribution device which can continuously supply a sheet of wash water in a constant thickness to a spillway which directs the film of water onto a moving pulp sheet. It is another object of this invention to provide an improved distribution device that minimizes the heat loss involved in the distribution. Still another object of this invention is to provide an improved liquid distribution device which is not subject to plugging and, therefore, is less likely to produce varying thicknesses in the sheet of liquid being distributed. Still, other objects will be apparent from the more detailed description of this invention which follows.

BRIEF DESCRIPTION OF THE INVENTION

This invention involves a liquid distribution device comprising an elongated horizontal pipe member having a plurality of spaced passageways through the pipewall substantially aligned axially along the top of the pipe member, an elongated trough-shaped deflection shield positioned over the passageways with its convex portions facing upwardly, an elongated adjustable slit opening between an edge of the deflection shield and the outside of the pipe member, a spillway for delivering liquid in the form of a thin flowing sheet from the slit opening to a receiving surface, means for supplying liquid under pressure to the inside of the pipe member, and means for adjusting the thickness of the slit opening. In specific embodiments of this invention, the deflecting shield is attached to the outside of the pipe member by a hinge along the edge opposite to the edge forming the slit opening and is sealed to the outside of the pipe member so that liquid can flow outwardly only through the slit opening. In another embodiment of this invention the inside of the pipe member includes baffles to divert the flow of liquid through the pipe member and thereby to control its velocity.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
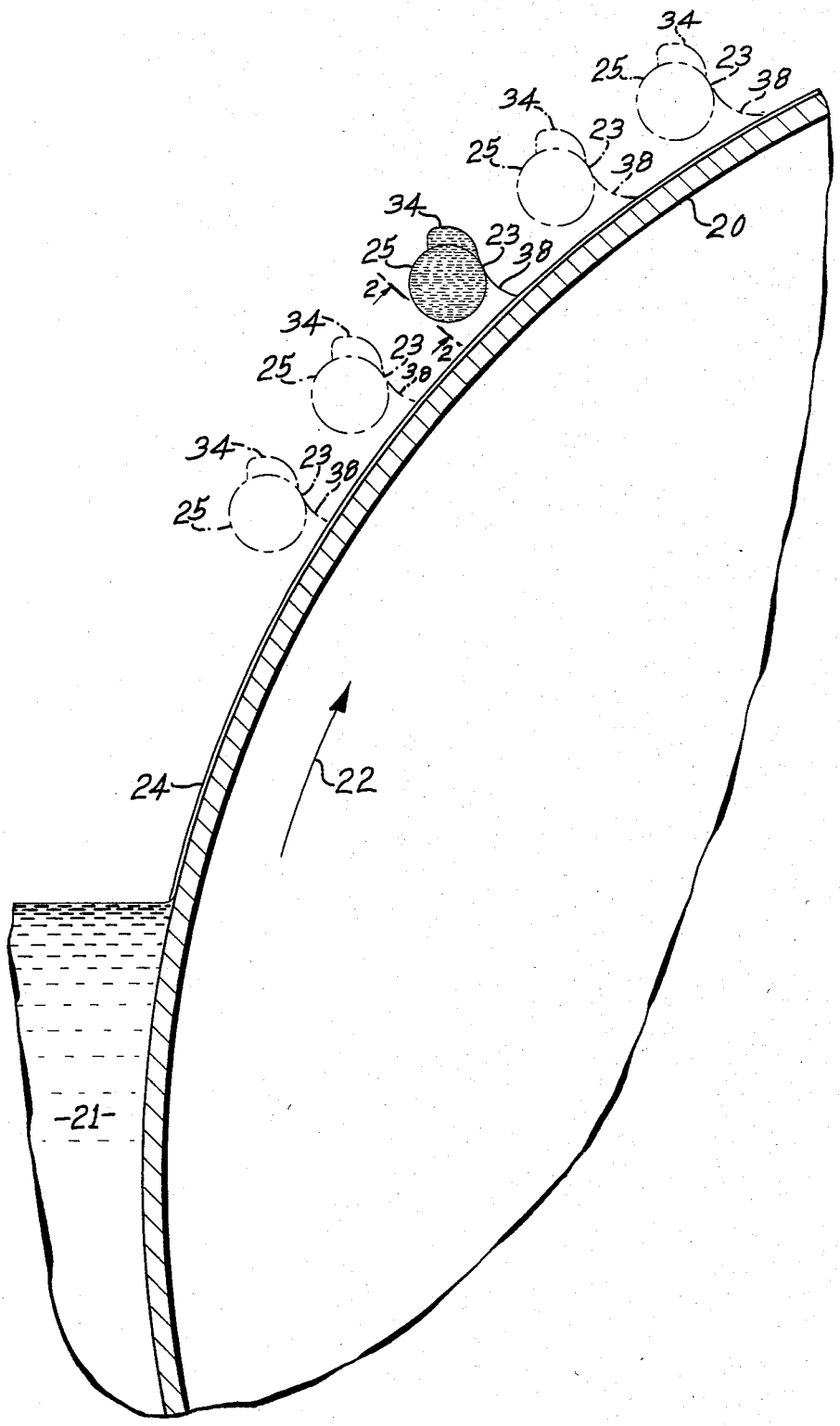
FIG. 1 is a partial cross sectional view showing the use of a plurality of liquid distribution devices of this invention to wash a wet pulp sheet in the paper making industry.

The use of the device of this invention in the pulp paper industry is shown in FIG. 1. A large pulp sheeting drum 20 is partially submerged in an aqueous pulp dispersion 21 and continuously rotated in the direction of arrow 22 while suction is applied from the interior of drum 20. This forms a thin sheet 24 of pulp on drum 20 which must be washed dried and pressed to eventually become a sheet of paper. Five water showering devices 23 of this invention are shown employed in series to provide the washing operation necessary to clean the pulp as it is formed into a sheet. Each showering device 23 comprises a pipe header 25 into which wash water flows to form a reservoir. Water from header 25 flows through small passageways from header 25 into deflector shield 34 and out through a slit orifice onto distribution plate 38 which conducts the wash water in the form of a thin sheet onto the pulp sheet 24 passing by on drum 20.

Figure 2:
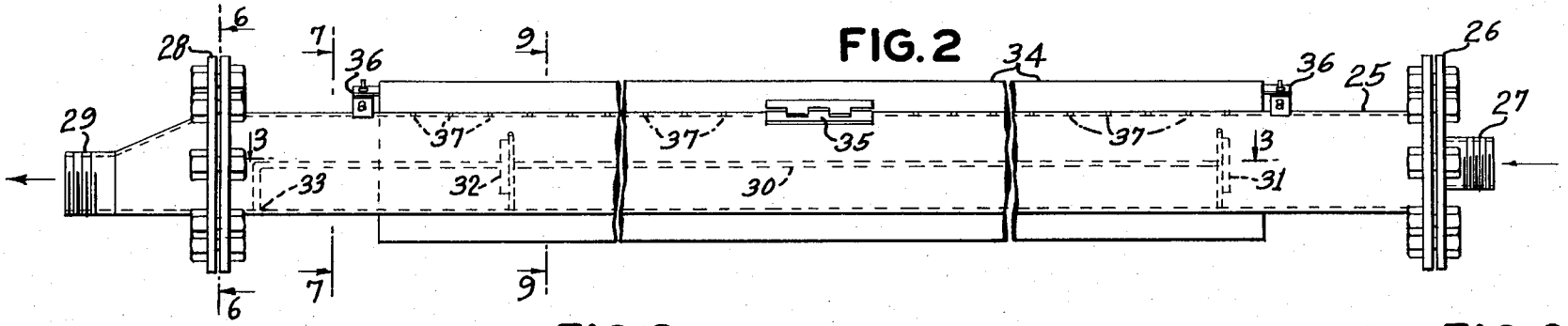
FIG. 2 is a front elevational view of the liquid distribution device of this invention.
Figure 3:
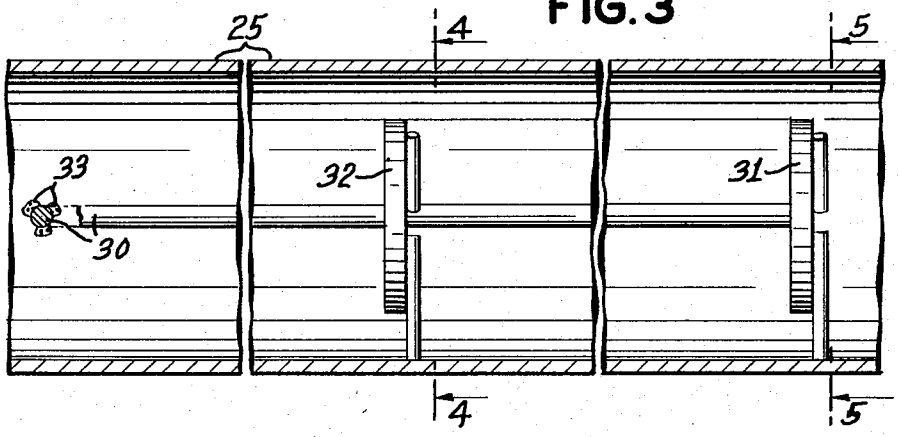
FIG. 3 is a partial cross sectional view taken at 3—3 of FIG. 2.
Figure 4:
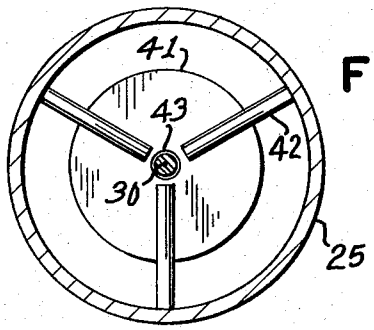
FIG. 4 is a cross sectional view taken at 4—4 of FIG. 3.
Figure 5:
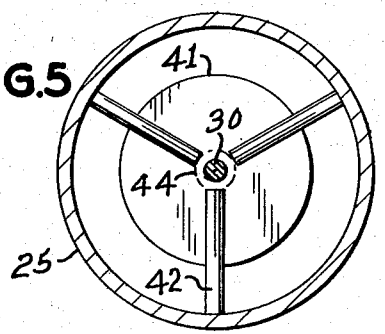
FIG. 5 is a cross sectional view taken at 5—5 of FIG. 3.
Figure 7:
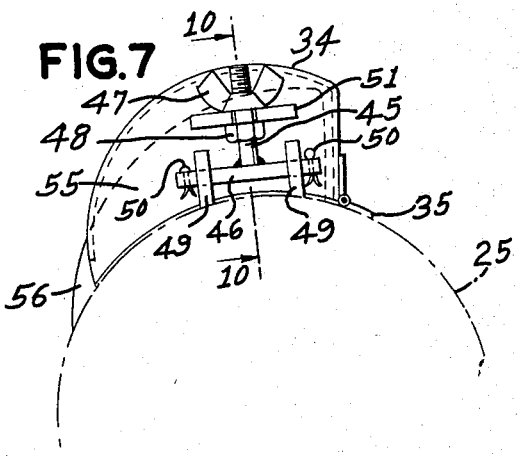
FIG. 7 is a cross sectional view taken at 7—7 of FIG. 2.

The details of the showering device of this invention are seen in FIGS. 2–12. The main body and supporting structure of the device of this invention is a large pipe 25 forming a header or a reservoir when it is filled with necessary liquid being distributed, which in the case of the pulp and paper industry is wash water. Liquid enters pipe 27 passing through flange assembly 26 through the interior portion of header 25 and eventually exits through flange assembly 28 and output pipe 29. In order to control the velocity of the wash water passing through header 25 it has been found desirable to employ a plurality of lateral baffles 31 and 32 to divert the liquid flow laterally and thus permit a better control of the overall velocity of liquid through header 25. In this embodiment of the invention baffles 31 and 32 are supported by a central rod 30 which is welded or otherwise fastened to the interior of header 25 at 33. The baffles employed may be any design of lateral obstruction to prevent a central core of liquid from flowing rapidly through header 25 from inlet to outlet. In the drawings of this invention there are shown baffles comprising a central disk 41 supported by a plurality(three in this instance) of spaced legs positioned approximately at equal angles to each other. Plate 41 can be pierced centrally with a drilled hole 43 as shown in FIG. 4 so that it may slide over central support rod 30 and be positioned wherever desired in the length of header 25. First baffle 31 need not be pierced centrally with a hole but can be fashioned to receive the end of support rod 30 in a central clearance 44 formed by the interior ends of spacer legs 42. Preferably each of the baffles 31 and 32 is welded to rod 30 to maintain it in its selected position.

Wash water passing through the interior of header 25 enters cover or deflecting shield 34 through a plurality of spaced passageways 37 through the wall of header 25. Preferably deflecting shield 34 is placed on the top of horizontally positioned header 25, and therefore, passageways 37 can be a series of holes aligned generally along an axial direction and spaced apart from each other so as to provide a communication from the interior of header 25 to the interior of deflecting shield 34. Deflecting shield 34 is generally a trough-shaped elongated member with its concave side facing downwardly against the outside of header 25 and its closed convex portion facing upwardly. Along its rear edges deflecting shield 34 is attached to the outside of header 25 by a plurality of hinges 35. Along the front edge of deflecting shield 34 there is an adjustable slit opening between the edge of deflecting shield 34 and the outside surface of header 25 which, in effect, is an orifice for the wash water causing it to form a thin sheet of liquid. This sheet of liquid is then conducted along a distribution plate 38 to a surface for receiving that liquid. Deflecting shield 34 is adjusted with respect to the slit opening by means of a clamp 36 attached at each end of deflecting shield 34. By having passageways 37 at the top of a horizontal header 25 there is less chance for any passageways 37 to become plugged by solid materials that may be in the liquid which would normally tend to settle to the bottom of header 25 by reason of gravity. Hinge 35 makes it possible, when clamping means 36 are released, to pivot deflecting shield 34 around the hinge pin and permit rapid and easy cleaning of any passageway 37 that may be obstructing the normal flow of liquid.

Figure 6:
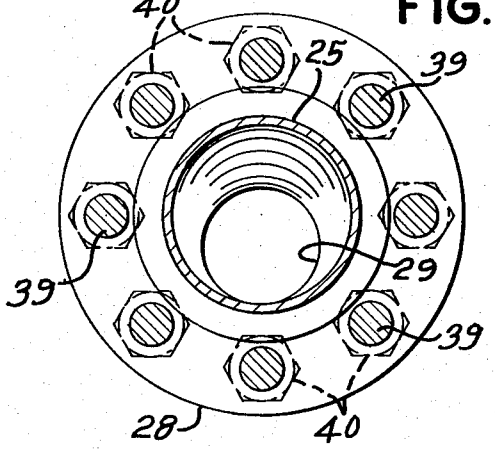
FIG. 6 is a cross sectional view taken at 6—6 of FIG. 2.

In FIG. 6 there is shown a section through flange assembly 28 indicating that it comprises the normal arrangement of a series of bolts 39 and nuts 40. Outlet 29 is shown as a reduced section tapering down from the enlarged diameter of header 25. In a typical washing operation in the pulp and paper industry header 25 may be approximately 4 inches in diameter while outlet 29 may be $2\frac{1}{2}$ inches in diameter.

In FIGS. 7–10 some of the features of the showering device of this invention are shown. Deflecting shield 34 is a trough-shaped member having end plates 55 which thereby define an enclosed space for receiving liquid from passageways 37. The only outlet from the enclosed space within deflecting shield 34 is a narrow slit opening 54 which permits the liquid inside of deflecting shield 34 to flow outwardly in the form of a thin sheet of liquid onto distribution plate 38 which, in turn, conducts the liquid to the surface receiving that liquid, e.g. pulp sheet 24 on drum 20 as shown in FIG. 1. The remaining edges around deflecting shield 34 are sealed to prevent any substantial leakage of liquid except that through slit opening 54. For example the back side of deflecting shield 34 is attached to the outside surface of header 25 by means of hinge 35. There must be a clearance between header 25 and deflecting shield 34, along the pivot axis. The means to prevent leakage between the header 25 and that portion of deflecting shield 34 is a flexible seal 52 which may be made of rubber or other similar material that will prevent the leakage of liquid out of the lower back edge of shield 34 where it joins the outside surface of header 25. In order to maintain seal 52 in its desired position it is preferred to employ L-shaped support 53 which is welded or otherwise fixed to the inside surface of deflecting shield 34. At the two ends of deflecting shield 34 are end plates 55 which slide snugly against seal plates 56 attached to the outside surface of header 25. There is no need normally to employ any resilient seal between these two plates since the pressures involved are small enough that only a minimum leakage may occur between these two plates 55 and 56. The forward edge of deflecting shield 34 is made to be adjustable with respect to the outside surface of header 25 or to the surface of distribution plate 38 when such is employed. In the instance shown in FIG. 9 distribution plate 38 extends upwardly sufficiently far to cooperate with the forward edge of deflecting shield 34 in forming the slit opening 54 which functions as an orifice for the liquid distributed onto plate 38. Preferably several stiffening gusset plates 58 are employed in spaced relationship to each other to maintain the forward edge of deflecting shield 34 parallel to distributing plate 38 when deflecting shield 34 is long, i.e. at least about 4 feet. In the paper pulp industry sheet forming drums (20 in FIG. 1) are 16 feet long and therefore several gusset plates 58 are required for deflection shield 34 on a washing device of this invention which necessarily would also be 16 feet long.

Figure 8:
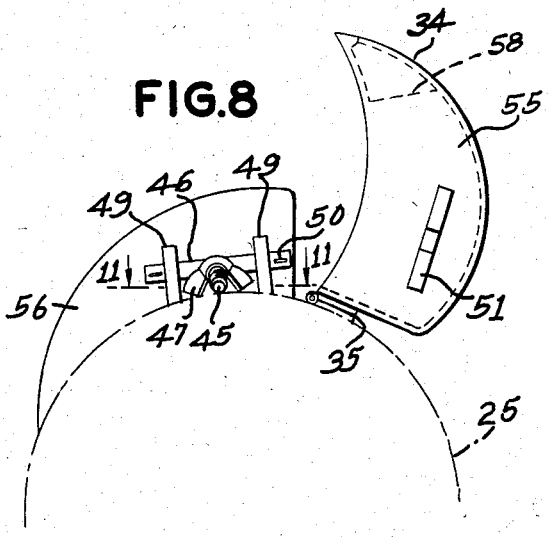
FIG. 8 is a view similar to that of FIG. 7 showing the opening of the hinged deflecting shield.
Figure 9:
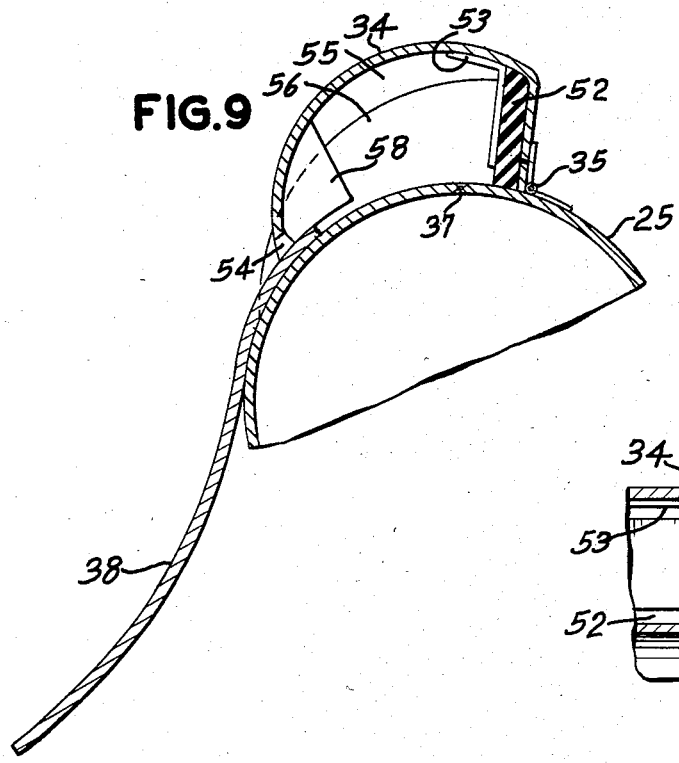
FIG. 9 is a cross sectional view taken at 9—9 of FIG. 2.

The mechanism which is shown here for adjusting the width of slit opening 54 comprises a bolt 45 welded to a pivot pin 46 which is pivotally mounted in supports 49 attached to the outside of header 25. Slotted arm 51 is attached to the end plate 55 of deflecting shield 34. Adjustment of clamp nut 48 and wing nut 47 on the threaded section of bolt 45 causes slit opening 54 to narrow or to widen respectively. Bolt 45 is mounted on a pivot pin 46 so that when it is important to uncover passageways 37 for cleaning or inspection it may be done readily. As shown in FIG. 8 wing nut 47 may be unloosened and bolt 45 pivoted outwardly releasing it from the slot in arm 51. This releases deflecting shield 34 so that it may be opened by pivoting around hinge 35.

Figure 12:
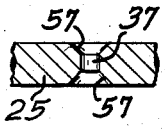
FIG. 12 is a partial cross sectional view taken at 12—12 of FIG. 11.
Figure 10:
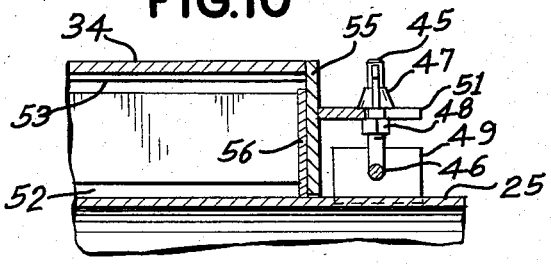
FIG. 10 is a cross sectional view taken at 10—10 of FIG. 7.
Figure 11:
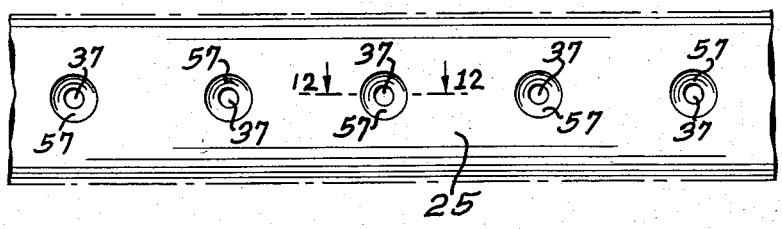
FIG. 11 is a partial top plan view taken at 11—11 of FIG. 8.

In FIGS. 11 and 12 passageways 37 are shown as drilled holes which have been countersunk or chamfered to remove any burrs that might otherwise snag dispersed particles in the liquid and cause plugging of the passageway.

In a test to indicate the improvement in delivery of water from the device of this invention as compared to one which did not include baffles in header such as those shown at 31 and 32 in FIG. 3 the following data were obtained. In the absence of baffles there is considerably larger volume of flow from the passageways near the outlet of header 25 as compared to those near the inlet of header 25. In contrast, when baffles were employed as shown in FIG. 2 in these drawings the following flow data were obtained from each of 16 passageways spaced 1 foot apart along a header 16 feet in length. The flow rates were measured at incicated pressures of zero and 1.2 on a pressure gauge. As seen in Table 1 below the values of flow in the device of this invention were substantially the same from one end of the long header to the other.

TABLE 1

| Passageway Position | Flow in Gal. /Min 0 psig. | 1.2 psig. |
|---|---|---|
| 1 | 10.44 | 14.36 |
| 2 | 11.52 | 16.50 |
| 3 | 12.96 | 16.25 |
| 4 | 11.52 | 15.75 |
| 5 | 11.52 | 16.66 |
| 6 | 9.64 | 17.00 |
| 7 | 10.08 | 16.52 |
| 8 | 10.64 | 16.50 |
| 9 | 10.64 | 16.66 |
| 10 | 10.08 | 15.50 |
| 11 | 10.08 | 15.25 |
| 12 | 11.52 | 16.30 |
| 13 | 11.52 | 16.30 |
| 14 | 11.52 | 16.30 |
| 15 | 11.52 | 16.30 |
| 16 | 11.52 | 16.30 |
| Total Flow | 176.72 | 258.45 |

Tests were made comparing a whistle shower device (well known in the pulp and paper industry) to the device of this invention. It was found that the whistle shower device caused a 4° F. temperature drop to occur in the water from the time it was inside the header to the time it contacts the wet pulp sheet. Under the same conditions the device of this invention produced only a 1° F. temperature drop. If these energy savings are applied to a plant unit delivering 800 gallons per minute of wash water it would result in savings of over $45,000 per year. It should be readily apparent from these tests that the device of this invention exhibits considerable improvement over those of the prior art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A liquid distribution device comprising an elongated tubular horizontal reservoir for holding liquid to be distributed, an elongated arcuate cap member extending substantially along said reservoir, a plurality of passageways through the upper wall of said reservoir and communicating with an elongated generally arcuate space substantially enclosed by said cap member for receiving liquid from said reservoir, said cap member having an elongated outlet edge which is spaced from said passageways and adjustable with respect to the outside surface of said reservoir to define an elongated substantially continuous narrow slit outlet through which the liquid flows in the form of a thin sheet substantially throughout the length of said cap member.

2. The device of claim 1 wherein said cap member includes another elongated edge, and hinge means attaching said other elongated edge to the outside of said reservoir.

3. The device of claim 1 further including a spillway to receive liquid flowing from said narrow slit outlet and to direct a flowing film of liquid to a receiving surface.

4. The device of claim 1 wherein said reservoir is a section of pipe connected at one end portion to a liquid source under pressure and through which said liquid flows continuously.

5. The device of claim 1 wherein said passageways are substantially aligned axially of said reservoir and are spaced substantially equidistant from each other.

6. The device of claim 1 which includes flow baffle means inside said reservoir to control the velocity of the liquid flowing through said reservoir.

7. The device of claim 6 wherein said baffle means comprises a plurality of plates to divert the flow of liquid laterally while flowing axially through said reservoir.

8. The device of claim 1 further comprising screw thread clamping means connected between said cap member and said reservoir for adjusting the distance between said outlet edge of said cap member with respect to the outside of said reservoir.

9. The device of claim 8 wherein said screw thread clamping means includes a pivotable bolt attached to said reservoir and a U-shaped slotted arm attached to said cap member, said pivotal bolt being pivotal within the space formed by said U-shaped slotted arm and means secured to said bolt to adjustably fix the distance between said pivotal bolt and said U-shaped slotted arm.

10. A liquid distribution device comprising an elongated horizontal pipe member having a plurality of spaced passageways through the pipe wall substantially aligned axially along the top of said pipe member, an elongated trough-shaped deflection shield positioned over said passageways with its convex portion facing upwardly, an elongated substantially continuous adjustable slit opening spaced from said passageways and being defined by one longitudinal edge of said deflection shield and the outside of said pipe member, hinge means attaching said deflection shield to said outside of said pipe member along the other longitudinal edge of said deflection shield, a spillway for delivering liquid in the form of a thin, flowing continuous sheet from said slit opening to a receiving surface, means for supplying liquid under pressure to the inside of said pipe member, and means connected between said deflection shield and said pipe member for adjusting the thickness of said slit opening.

11. The device of claim 10 wherein the liquid is water and wherein the receiving surface is a revolving drum carrying a sheet of paper pulp on its surface.

12. The device of claim 10 wherein said spillway is affixed to the outside of said pipe member and forms the fixed side of said slit opening against which said one edge of said deflecting shield is adjusted.

13. The device of claim 10 further comprising a plurality of spaced flow baffles positioned laterally within said pipe member to control the velocity of liquid being pressured through said pipe member.

14. The device of claim 10 further comprising sealing means between said deflection shield and said pipe member for inhibiting egress of liquid at any location except said slit opening.

15. The device of claim 14 wherein said sealing means includes a spaced pair of upstanding stationary members attached to said outside of said pipe member is sliding contact with respective lateral end portions of said deflection shield.

16. The device of claim 14 wherein said sealing means includes an elongated resilient pad attached to said deflection shield and pressed against the outside of the pipe member along said other longitudinal edge of said deflecting shield.

* * * * *